US007997758B2

(12) United States Patent
Zhang et al.

(10) Patent No.: US 7,997,758 B2
(45) Date of Patent: Aug. 16, 2011

(54) LIGHT-GUIDING MODULE AND LED LIGHT SOURCE USING THE SAME

(75) Inventors: Yi Zhang, Shenzhen (CN); Cheng-Tien Lai, Taipei Hsien (TW); Jin-Song Feng, Shenzhen (CN); Wei-Le Wu, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 193 days.

(21) Appl. No.: 12/340,488

(22) Filed: Dec. 19, 2008

(65) Prior Publication Data

US 2009/0290342 A1 Nov. 26, 2009

(30) Foreign Application Priority Data

May 23, 2008 (CN) ..... 2008 1 0067419

(51) Int. Cl.
*F21V 17/10* (2006.01)

(52) U.S. Cl. ..... 362/235; 362/249.02; 362/249.11; 362/238; 362/241; 362/296.01; 362/342; 362/800

(58) Field of Classification Search ..... 362/249.02, 362/235, 248.11, 237, 238, 240, 241, 243, 362/296.01, 342, 341, 217.03, 290, 292, 362/325
See application file for complete search history.

(56) References Cited

U.S. PATENT DOCUMENTS

| | | | | |
|---|---|---|---|---|
| 4,628,421 | A * | 12/1986 | Saar | 362/238 |
| 7,033,060 | B2 * | 4/2006 | Dubuc | 362/600 |
| 7,674,010 | B2 * | 3/2010 | Griffiths et al. | 362/249.02 |
| 2006/0164833 | A1 * | 7/2006 | Parkyn et al. | 362/235 |
| 2007/0230171 | A1 * | 10/2007 | Hiratsuka | 362/235 |
| 2007/0279904 | A1 * | 12/2007 | Tasch et al. | 362/235 |

FOREIGN PATENT DOCUMENTS

CN 1967045 A 5/2007

* cited by examiner

*Primary Examiner* — Robert May
*Assistant Examiner* — Leah S Lovell
(74) *Attorney, Agent, or Firm* — Frank R. Niranjan

(57) ABSTRACT

An LED light source includes an LED module and a light-guiding module fixed on the LED module. The LED module includes a printed circuit board and a plurality of LEDs. The light-guiding module includes a frame placed on the LED module and a plurality of light guiding units engaging with the frame. The frame defines an opening in a lower portion thereof to receive the LEDs of the LED module therein and a recess in an upper portion thereof and in communication with the opening. Each of the light guiding units has a base with two flanges respectively fittingly received in two cutouts of the recess of the frame so that the light guiding unit is movable along the recess until it faces a corresponding LED.

2 Claims, 6 Drawing Sheets

LIGHT-GUIDING MODULE AND LED LIGHT SOURCE USING THE SAME

BACKGROUND OF THE INVENTION

1. Field of the Invention

The disclosure relates to an LED light source, and more particularly to an LED light source using a light-guiding module applicable with various types of LED modules.

2. Description of Related Art

An LED light source is a type of solid-state lighting that utilizes light-emitting diodes (LEDs) as a source of illumination. LEDs convert electricity to light via current through a junction region comprising two different semiconductors, by which electrons and holes coupled at the junction region generate the light. LED advantages of resistance to impact and nearly limitless lifetime under specific conditions make an LED light source a cost-effective yet high quality replacement for incandescent and fluorescent lamps.

Known implementations of LED modules in an LED light source use a plurality of individual LEDs to generate light reflected by a light-guiding module to obtain sufficient illumination of suitably wide distribution. A conventional light-guiding module is integrally fabricated and suited only for use in the type of LED light source for which its use is intended, such that in order to equip a variety of LED light sources, development and manufacture of a wide range of light-guiding module types are required, representing considerable cost and material burdens.

What is needed, therefore, is a light-guiding module suitable for application with a variety of LED light source types, thereby overcoming the described limitations.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION OF THE INVENTION

Figure 1:
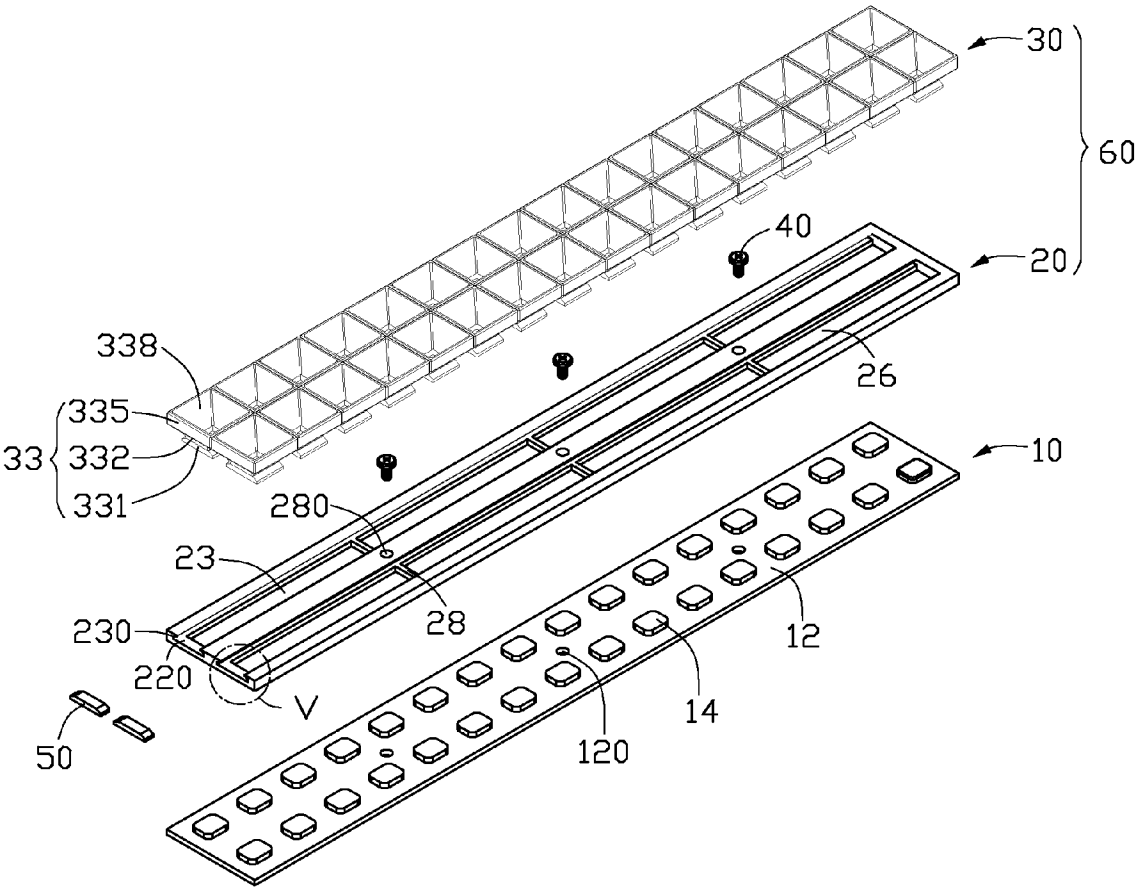
FIG. 1 is an isometric, exploded view of an LED light source in accordance with a preferred embodiment of the disclosure.

Referring to FIG. 1, an LED light source in accordance with a preferred embodiment is illustrated. The LED light source comprises an LED module 10 and a light-guiding module 60 fixed to a top of the LED module 10.

The LED module 10 comprises an elongated printed circuit board 12 and a plurality of spaced LEDs 14 evenly mounted on a top side of the printed circuit board 12. The LEDs 14 are arranged in two parallel rows symmetrical relative to a longitudinal central axis of the printed circuit board 12. The printed circuit board 12 defines a plurality of extending orifices 120 therein; in this embodiment, an amount of the extending orifices 120 is three. The orifices 120 are evenly arranged in the longitudinal central axis of the printed circuit board 12.

Figure 6:
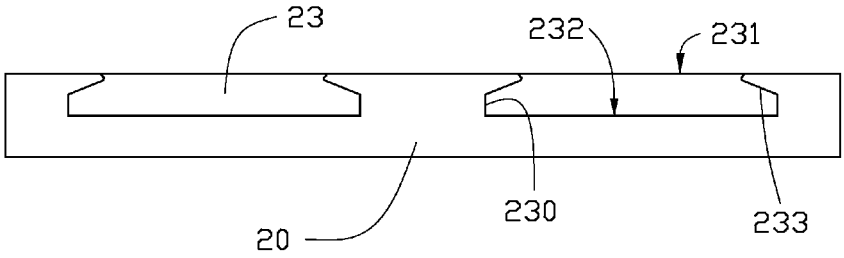
FIG. 6 is a lateral view of a frame of the LED light source of FIG. 1.

The light-guiding module 60 comprises a frame 20 and two light guiding unit arrays 30 engaging with the frame 20. The frame 20 has a rectangular and elongated shape corresponding to the printed circuit board 12 of the LED module 10. The frame 20 defines a plurality of extending holes 280 in a longitudinal central axis of the frame 20 and corresponding to the extending orifices 120 of the printed circuit board 12. The frame 20 forms a pair of elongated recesses 23 in an upper portion thereof. The recesses 23 are spaced from each other and symmetrical relative to a longitudinal central axis of the frame 20. Each recess 23 is shaped to have a narrow top mouth 231 and a wide bottom portion 232 (please see FIG. 6). The frame 20 has slanting side walls 233 in two sides of the recess 23 from the narrow top mouth 231 to the wide bottom portion 232. Thus, each recess 23 has a dovetailed configuration as viewed from a lateral end of the frame 20. Two receiving voids 26 are extended vertically through the frame 20, located below centers of the bottom portions of the recesses 23 and communicated with the recesses 23, respectively. The receiving voids 26 are spaced from each other and symmetrical relative to the longitudinal central axis of the frame 20.

The lower portion of the frame 20 forms three ribs 28 in each receiving voids 26 to divide each receiving voids 26 into four segments (not labeled). The ribs 28 are located in alignment with the extending holes 280 along a transverse direction of the frame 20 to strengthen the frame 20. Each recess 23 includes two undercuts 230 defined at two opposite sides of thereof. The undercuts 230 of each recess 23 are parallel to each other and face to each other. The undercuts 230 of each recess 23 make the recess 23 have a trapezoidal cross section. One lateral end of each of the recesses of the frame 20 is opened to define an entrance 220 at the corresponding lateral end of each recess 23. An opposing lateral end of each recess 23 of the frame 20 is closed by a corresponding lateral end of the frame 20 to terminate each recess 23. The cutouts 230 of each of the recesses 23 function as runners for fittingly receiving the flanges 3310 of the base 331 of a corresponding light guiding unit 33 therein, thereby mounting the corresponding light guiding unit 33 on the frame 20.

Figure 2:
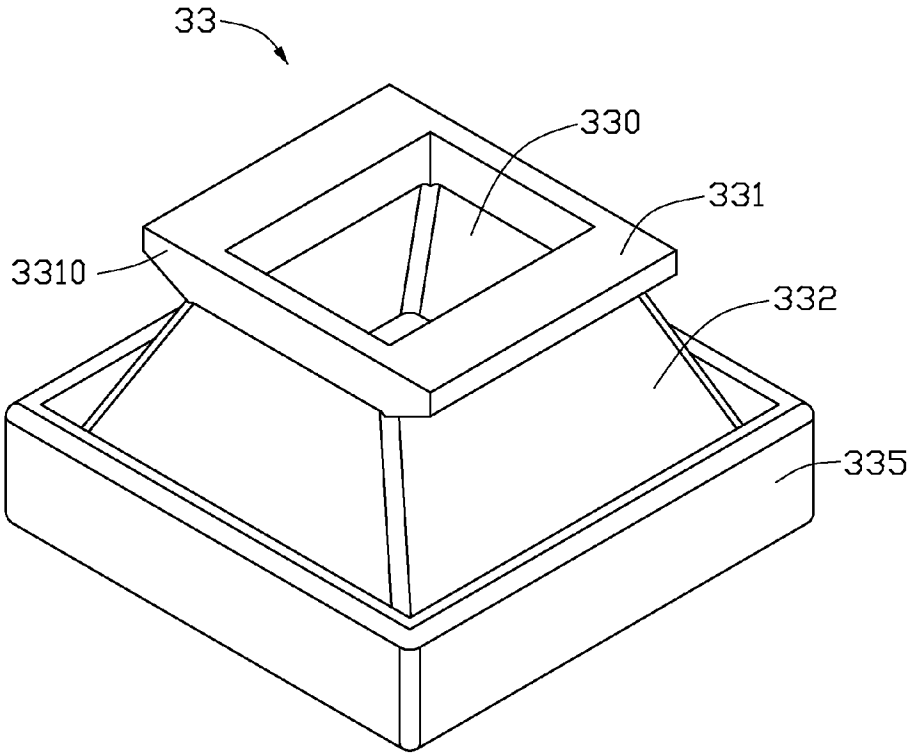
FIG. 2 is an enlarged, inverted view of a light guiding unit of the LED light source of FIG. 1.
Figure 3:
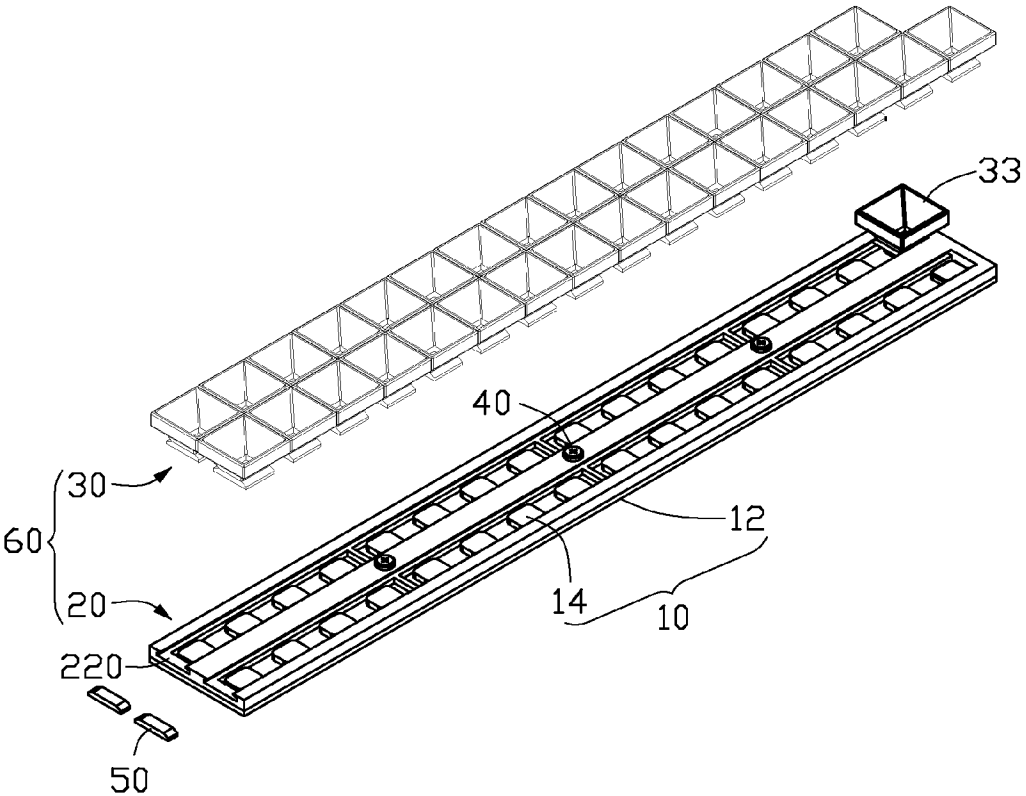
FIG. 3 is a partially assembled view of the LED light source of FIG. 1.
Figure 4:
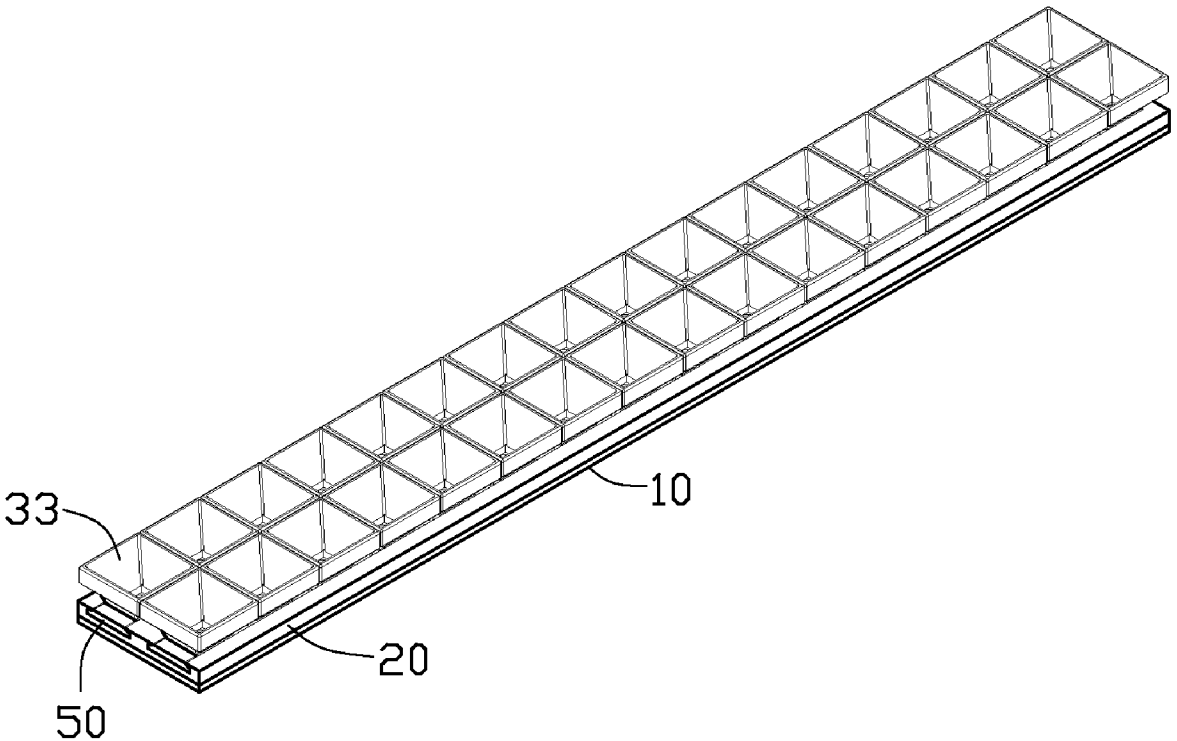
FIG. 4 is an assembled view of the LED light source of FIG. 1.
Figure 5:
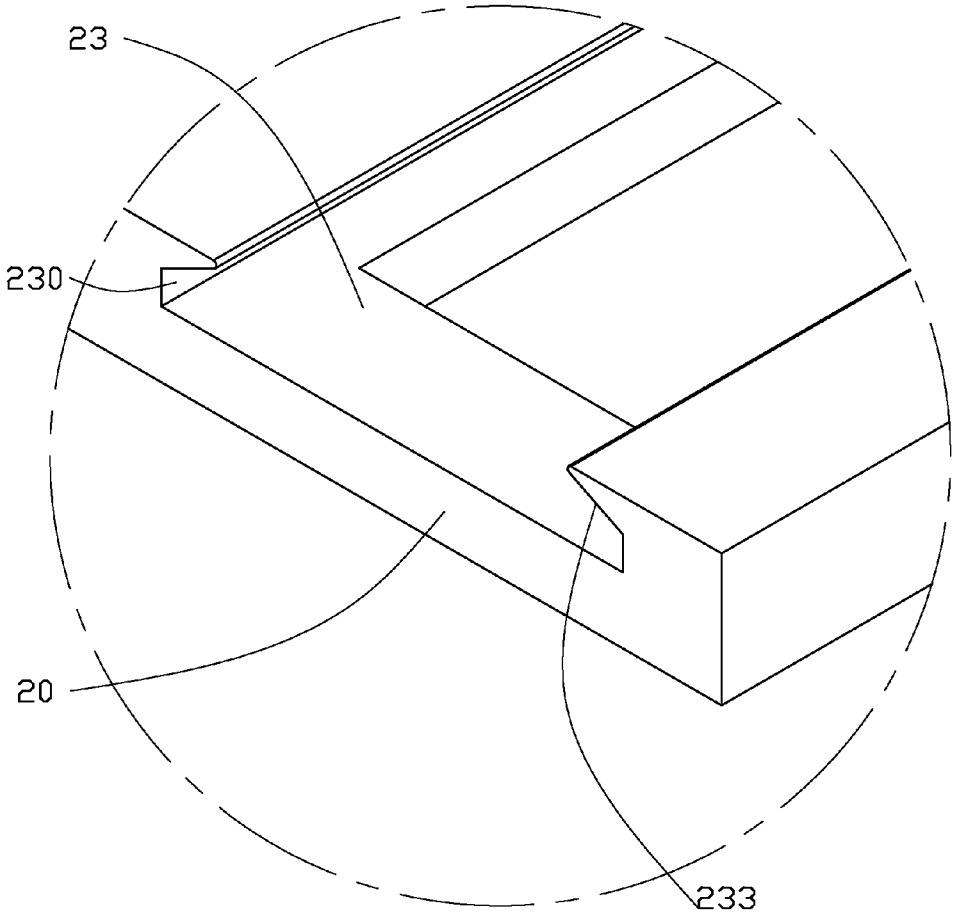
FIG. 5 is an enlarged view of a circled portion V of FIG. 1.

The light guiding unit arrays 30 comprise a plurality of light guiding units 33 individual from each other. Each of the light guiding units 33 is integrally manufactured. Each of the light guiding units 33 is located corresponding to each of the LEDs 14. Referring also to FIG. 2, each of the light guiding units 33 comprises a rectangular base 331 defining a rectangular lower opening 330 at bottom thereof, four inclined sidewalls 332 extending from the base 331 and interconnected to define a rectangular upper opening 338 by upper ends thereof. The upper opening 338 is in communication with the lower opening 330. The lower opening 330 is smaller than the upper opening 338. The base 331 has a cross section similar to that of the recess 23. Lower end of the base 331 has a width larger than a width of upper end of the base 331. Two lateral flanges 3310 of the base 331 engage in the undercuts 230 of each of the recesses 23 when the base 331 of the light guiding unit 33 is received in a corresponding recess 23. Thus, the base 331 of each light guiding unit 33 is engaged in the recess 23 to mount the light guiding unit 33 on the frame 20, wherein the light guiding units 33 are movable along a longitudinal direction of the frame 20. Each of the light guiding units 33 has four engaging flanges 335 extending laterally and perpendicularly from the upper ends of the inclined sidewalls 332.

Referring also to FIGS. 3-6, during assembly, the frame 20 is placed on the printed circuit board 12 of the LED module 10. The LEDs 14 of the LED module 10 respectively project into the receiving voids 26 of the frame 20, without reaching the recesses 23. Three screws 40 extend through the extending holes 280 of the frame 20 to engage in the extending orifices 120 of the printed circuit board 12 for mounting the frame 20 onto the LED module 10. The bases 331 of the light guiding units 33 are inserted into the recesses 23 of the upper portion of the frame 20 from the entrances 220 of the recesses 23. The flanges 3310 of the light guiding units 33 are movable along the recesses 23 until the light guiding units 33 reach proper positions where the lower openings 330 of the light guiding units 33 are respectively in alignment and face directly to the corresponding LEDs 14 of the LED module 10 in the receiving voids 26. Each of the light guiding units 33 abuts against adjacent light guiding units 33 by the engaging flanges 335 thereof engaging with the engaging flanges 335 of the adjacent light guiding units 33. Two baffling blocks 50 are inserted in the entrances 220 of the recesses 23 respectively to block the light guiding units 33 in the recesses 23 of the frame 20, thereby preventing the guiding units 33 from leaving the frame 20 via the entrances 220. The baffling blocks 50 are made of rubber in this embodiment.

According to the previously mentioned descriptions, the individual light guiding units 33 are assembled into the frames 20 to form the light-guiding modules 60, suitable for the LED module 10 of the disclosed embodiment and further for various types of frames to suit different types of LED module in different LED light sources.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A light-guiding module for being fixed on an LED module to guide light emitted by a plurality of LEDs of the LED module, comprising:

a frame for being placed on the LED module, defining a void in a bottom portion thereof for receiving the LEDs of the LED module and a recess in an upper portion thereof and in communication with the void, the recess being shaped to have a narrow top mouth and a wide bottom portion, the recess having two undercuts at two sides of the wide bottom portion of the recess and slanting side walls in the recess from the narrow top mouth to the wide bottom portion so that the recess has a dovetailed profile; and a plurality of light guiding units each comprising a base having two flanges extending outwardly and laterally from two opposite lateral sides thereof;

wherein the flanges of the base of each of the light guiding units are respectively received in the undercuts of the frame and movable along the recess to adjust a position of each of the light guiding units in the frame until each of the light guiding units faces a corresponding LED for reflecting and guiding light generated by the corresponding LED in a predetermined manner wherein each of the light guiding units comprises four inclined sidewalls extending from the base and interconnected to each other to define a rectangular upper opening by upper ends thereof, the base defining a lower opening in communication with the upper opening; and wherein the lower opening is smaller than the upper opening and in communication with the void of the frame.

2. An LED light source comprising:

an LED module comprising a printed circuit board and a plurality of LEDs mounted on the printed circuit board;

a light-guiding module fixed on the LED module to guide light emitted by the LEDs of the LED module, comprising:

a frame placed on the LED module and defining a void in a lower portion thereof to receive the LEDs of the LED module therein and a recess in an upper portion thereof and in communication with the void, the recess having two runners at two sides thereof, the recess having a narrow top mouth and a wide bottom portion to form slanting side walls in the recess from the narrow top mouth to the wide bottom portion so that the recess has a dovetailed profile; and a plurality of light guiding units each having a base having two flanges extending outwardly and laterally from two opposite lateral sides thereof;

wherein the flanges of the base of each of the light guiding units are respectively received in the runners of the frame and movable along the recess to adjust a position of each of the light guiding units in the frame until each of the light guiding units faces a corresponding LED for reflecting and guiding light generated by the corresponding LED in a predetermined manner; and wherein each of the light guiding units comprises four inclined sidewalls extending from the base and interconnected to each other to define a rectangular upper opening by upper ends thereof, the base defining a lower opening in communication with the upper opening.

* * * * *